United States Patent [19]

Stroup

[11] 4,269,369

[45] May 26, 1981

[54] POWER DRIVEN DEREELER WITH STRAND TENSION-SENSING DEVICE

[75] Inventor: Steven L. Stroup, Bluffton, Ind.

[73] Assignee: Crown Unlimited Machines, Inc., Bluffton, Ind.

[21] Appl. No.: 63,679

[22] Filed: Aug. 6, 1979

[51] Int. Cl.[3] ..... B65H 59/38

[52] U.S. Cl. ..... 242/45; 242/78.6

[58] Field of Search ..... 242/45, 128, 129, 78, 242/78.6, 54 R

[56] References Cited

U.S. PATENT DOCUMENTS

| | | | |
|---|---|---|---|
| 1,952,782 | 3/1934 | Steadley | 242/45 |
| 2,271,416 | 1/1942 | Davis et al. | 242/45 |
| 2,664,250 | 12/1953 | Friedman | 242/54 R |
| 3,137,452 | 6/1964 | Winders | 242/45 X |
| 3,162,394 | 12/1964 | Culpepper et al. | 242/78.6 |
| 3,282,518 | 11/1966 | Holmes | 242/128 X |
| 3,381,913 | 5/1968 | Bachman | 242/78.6 |
| 3,392,931 | 7/1968 | Davis et al. | 242/78.6 |
| 3,436,031 | 4/1969 | Winders | 242/45 X |
| 3,476,330 | 11/1969 | Curtland | 242/45 |
| 3,502,828 | 3/1970 | Pestalozzi | 242/45 X |
| 3,544,029 | 12/1970 | Meier | 242/78.6 |

*Primary Examiner*—Stanley N. Gilreath

*Attorney, Agent, or Firm*—Gust, Irish, Jeffers & Hoffman

[57] ABSTRACT

A power driven dereeling apparatus comprising a supporting frame which carries for rotation thereon a table adapted to carry a reel of strand material coiled thereon. An electric motor is connected to rotate the table. A device is provided for sensing the tension of a strand being drawn off the reel, this device being fixedly disposed relative to the frame. The device further includes a cam roller engageable by a strand being drawn off the reel, the roller being movable between first and second positions in response to a predetermined change in tension of such strand. An electrical switch is disposed to be responsive to movement of said cam roller to said first position due to an increase in tension for energizing the aforesaid motor. This in turn causes rotation of the table and reel mounted in a direction to pay strand material off the reel. If withdrawal of strand from the reel is stopped or if the table rotation pay off speed exceeds the speed of the machine consuming strand of material, the slight overrun of the table and reel will relax the tension on the strand, thereby permitting the cam roller to move to its second position to thereby actuate the electrical switch oppositely. This results in deenergizing the motor and energizing an electrical brake to prevent reel overrun and disorientation of the reel of material.

4 Claims, 7 Drawing Figures

POWER DRIVEN DEREELER WITH STRAND TENSION-SENSING DEVICE

BACKGROUND OF THE INVENTION

1. Field of the Invention

The present invention relates to dereeling apparatuses and more particularly to a power driven apparatus which is controlled in its operation in response to the tension of a strand being dereeled.

2. Description of the Prior Art

It is customary to wrap long lengths of a strand material, such as wire, tubing, or strip steel, onto a reel or spool having a barrel and end flanges. In the winding of coils from such strand, it is conventional to connect one end of the strand to a winding mechanism which pulls strand off the reel. This results in strand being payed off the reel, the direction of pay-off being either axially or circumferentially of the spool. If circumferentially, the reel will be rotated at a speed depending upon the velocity at which the strand is drawn from the reel. Since the reel with the strand stored thereon has inertia, should the coil-winding operation suddenly cease, the reel will continue rotating for a short period of time coasting to a stop. During such rotation or overrun, the strand continues to uncoil thereby producing an enlarged loop or loops which can become entangled or fall off the reel.

This invention is concerned more particularly with strand material in the form of aluminum or the like tubing which is stored on relatively large reels and in amounts which are relatively heavy, such as five hundred pounds or more. Such reels are conventionally mounted for rotation on upright shafts with the tubing being drawn off the reel with sufficient force to cause rotation of the latter. During the winding of coils from the tubing, coil winding machinery is continuously starting and stopping operation at the beginning and end of winding the coil. This results in the reel being correspondingly started and stopped in rotation, the tension on the tubing during the coil-winding operation controlling the reel rotation. With the reel stationary, the beginning of a coil-winding operation results in suddenly tensioning the tubing which tension is applied to the reel to start rotation thereof. Since the coils of tubing on the reel are somewhat loose, it is not uncommon for the tubing to embed itself within or to chafe against the coils until the reel is started in its rotation and accelerates to full speed. Such embedment and chafing can damage the tubing thereby resulting in the production of defective coils.

Typical prior art apparatuses are disclosed in U.S. Pat. Nos. 2,417,818, 2,458,555, 2,946,536, 3,282,518, 3,806,054 and 3,815,844.

SUMMARY OF THE INVENTION

The present invention relates to a power driven dereeling apparatus wherein the tension of the strand does not rotate the reel. This apparatus includes a supporting frame having a driven means mounted thereon for rotating a reel of strand material. Driving means in the form of an electric motor or the like serves to impart rotation to the reel. A device is provided for sensing the tension of a strand being drawn off the reel, the device being fixedly disposed relatively to said frame. The sensing device includes a cam roller engageable by a strand being payed off the reel, the cam roller being movable between first and second positions in response to a predetermined change in tension of the strand. Means are responsive to movement of the cam roller to the first position due to an increase in tension for activating the electric motor which causes rotation of the driven means and reel in a direction to pay strand off the reel. Further, the device is responsive to movement of the cam roller to its second position for deactivating the electric motor and energizing an electrical brake when the tension decreases below a predetermined level whereby rotation of the reel is stopped. Means are provided for yieldably urging the cam roller toward the second position.

It is an object of this invention to provide a power driven dereeler which is controlled in its operation by means of a strand tension-sensing device.

The above-mentioned and other features and objects of this invention and the manner of attaining them will become more apparent and the invention itself will be best understood by reference to the following description of an embodiment of the invention taken in conjunction with the accompanying drawings.

DESCRIPTION OF A PREFERRED EMBODIMENT

Figure 1:
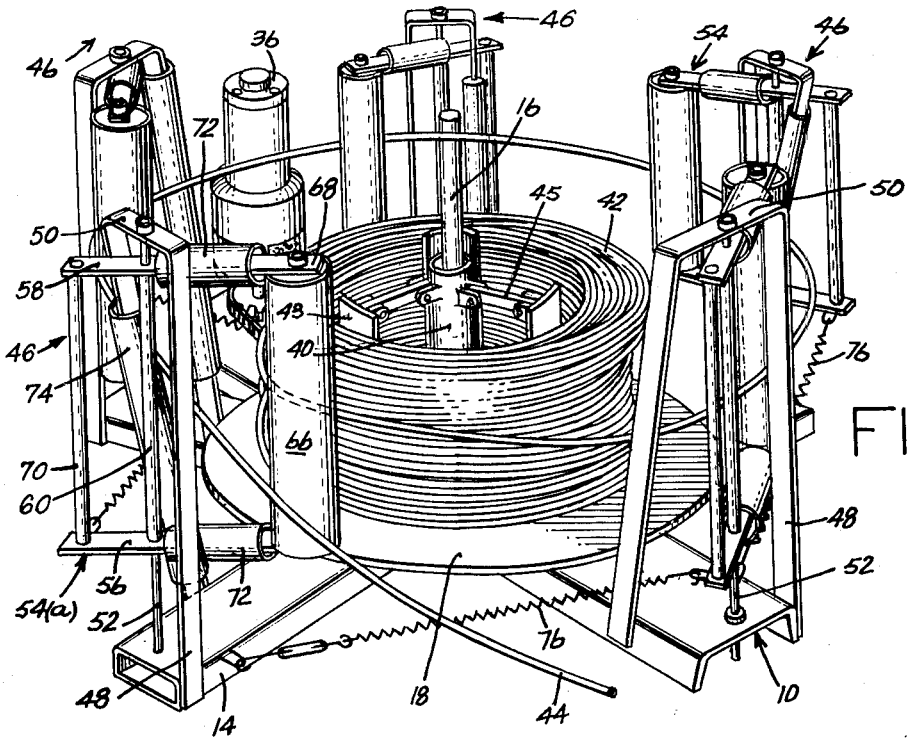
FIG. 1 is a perspective illustration of one embodiment of this invention.
Figure 2:
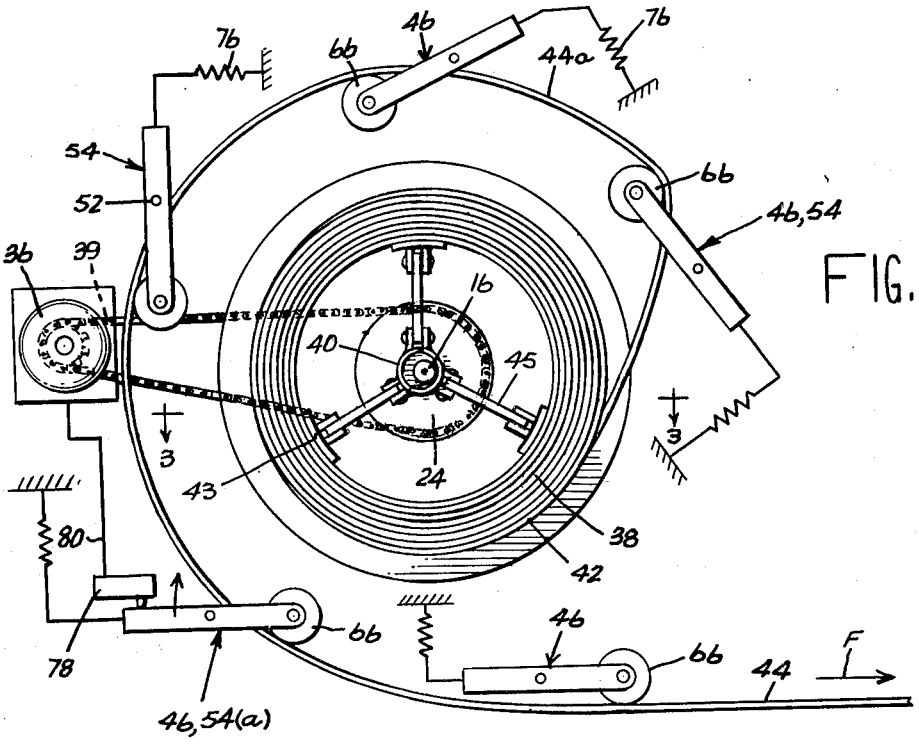
FIG. 2 is a top plan view thereof in partly diagrammatic form for clarity of illustration.
Figure 3:
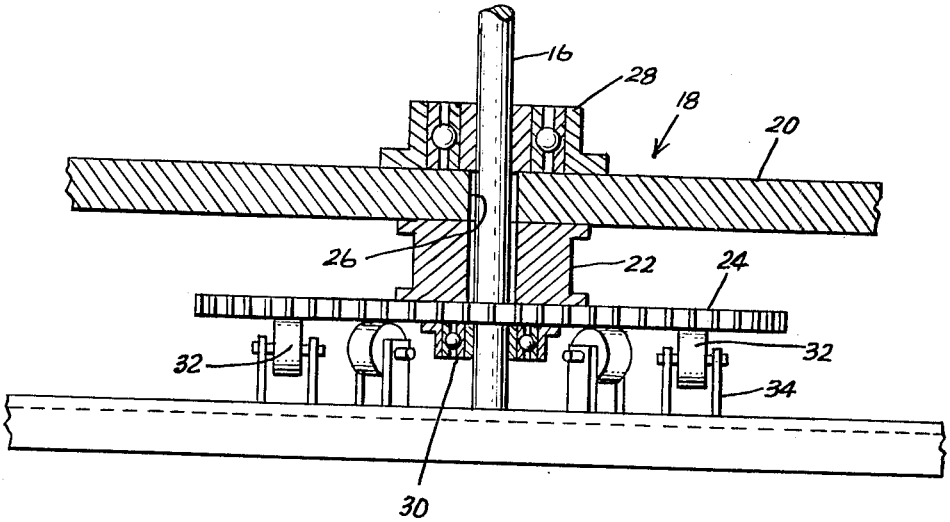
FIG. 3 is a fragmentary sectional view of the table and sprocket construction and taken substantially along section line 3—3 of FIG. 2.
Figure 4:
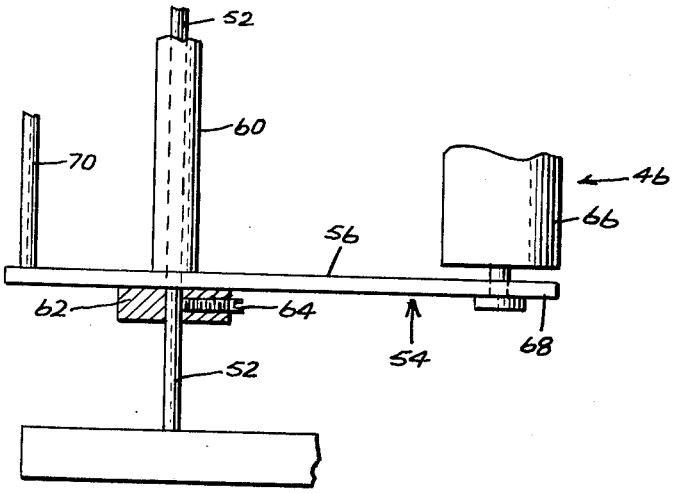
FIG. 4 is a fragmentary side view, partly sectioned, of the mounting of a pivot frame shown in FIGS. 1 and 2.
Figure 5:
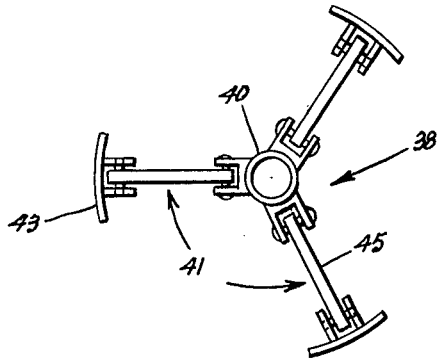
FIG. 5 is a top view of a coil-centering device.

Referring to the drawings, a stationary, rigid supporting frame generally indicated by the reference numeral 10 is fabricated of two or more lengths of steel channels 12 and 14 in a radiating pattern and suitably welded together. The upper surfaces of the channels 12 and 14 are disposed to be essentially coplanar and horizontal. Secured to the central portion of the frame 10 as by welding or the like is an upstanding, stationary shaft 16. A reel-supporting mechanism generally indicated by the numeral 18 is rotatably mounted on the shaft 16 and with respect to the frame 10. This reel-supporting mechanism 18 includes a disc shaped table 20, a cylindrical spacer 22 secured coaxially to the underside thereof, and a chain sprocket 24 secured to the other side of the spacer 22 thereby to form an integrated assembly. This assembly has a central opening 26 which receives with clearance the shaft 16. A first bearing 28 is coaxially mounted on the upper side of the table 20 and on the shaft 16. Another bearing 30 coaxially secured to the bottom of the sprocket 24 also mounts on the shaft 16. The integrated assembly of the table, spacer and sprocket 20, 22, 24 is thereby mounted for rotation on and about the shaft 16 by means of the two bearings 28 and 30.

The integrated assembly 20, 22, 24 is rotatably mounted on the frame 10 by means of a series of rollers 32 carried by the frame 10. Each roller 32 is supported by means of a bracket 34 upstanding from the frame 10, the sprocket 24 resting on the rollers 32. A multiplicity of rollers 32 is used, these being arranged in a circular pattern so as to be engageable by the underside of the sprocket 24. Thus, the rollers 32 in combination with the bearings 28 and 30 serve to mount the integrated table assembly 20, 22, 24 for rotation on the frame or platform 10.

An electric motor and brake combination 36 also mounted on the frame 10 is connected to the sprocket 24 by means of a drive chain 38.

Figure 6:
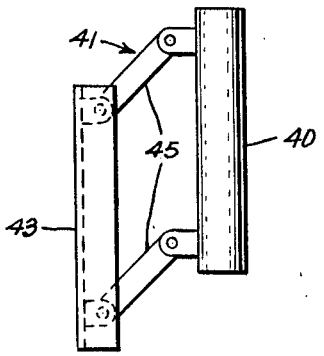
FIGS. 6 and 7 are side views of one spreader linkage thereof in spread and unspread conditions.

As shown more clearly in FIGS. 1, 2, 5, 6, and 7, a coil-centering device 38 includes an upright tubular element 40 which telescopes over post 16. Pivotally connected to the tubular member 40 are three equally angularly spaced, radially extending spreader linkages 41 having spreader bars 43 pivotally connected to member 40 by means of links 45. The device 38 is operated by raising and lowering the member 40 while the lower ends of bars 43 rest on table 20. Upon raising member 40 the weight of the bars 43 cause them to remain in a down or collapsed position by reason of the pivoting of links 45. Links 45 of each linkage 41 swing in parallelism thereby resulting in bars 43 moving radially inwardly as shown in FIG. 6. So positioned, the bars 43 define a circle about the center of post 16, which is smaller than the inner circumference of the coil 42.

Figure 7:
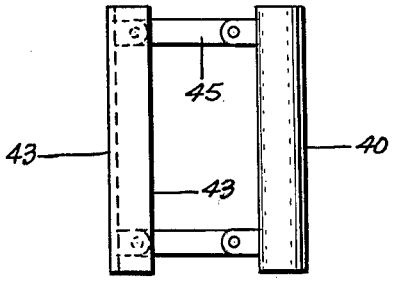

A coil 42 of a long length of aluminum tubing 44 or the like has an inner diameter which fits with clearance over the collapsed bars 43 while the coil rests on table 20. The member 40 is now forced downwardly causing the links 45 to straighten as shown in FIG. 7 forcing bars 43 uniformly radially outwardly into engagement with the inner perphery of coil 42. The coil 42 is now centered about post 16 and with respect to table 20 and because of its frictional engagement with table 20 will rotate therewith.

Circumferentially spaced about the reel 42 and radially outwardly therefrom are a plurality of coil-engaging units or assemblies generally indicated by the numeral 46. Since these units are identically constructed, a description of one will suffice for all. As appears more clearly in FIG. 2, the units 46 are spaced circumferentially around the reel 42 in generally equally spaced relation. Further, they generally define a circle coaxial with the post 16.

Each unit 46 is mounted on the frame 10 by means of a U-shaped bracket 48 upstanding therefrom, the lower ends of the bracket 48 being secured to a respective channel 12 by welding or the like and the upper ends having a crossbar 50 which extends essentially horizontally. Extending between the respective channel 12 and the crossbar 50 is a pivot post 52, the opposite ends of this post 52 being suitably secured against rotation. Pivotally mounted on the post 52 is a pivot frame 54 composed of two spaced parallel arms 56 and 58 having a rigid elongated sleeve or tube 60 extending therebetween. The sleeve 60 is telescoped for pivotal movement over the pivot post 52. An abuttment collar 62 fits over the pivot post 52 and is there secured in place by means of a set screw 64. The arm 56 of the pivot frame 54 rests on the collar 62 thereby supporting the frame 54 in elevated position.

A cam roller 66 is rotatably mounted between the juxtaposed ends 68 of the arms 56 and 58 as shown. The opposite ends of the arms 56 and 58 are rigidly connected together by means of a brace or bar 70. Thus the pivot frame 54 is a rigid assembly pivotally mounted on the upright post 52.

Protective tubes 72 of plastic are telescoped over the respective arms 56 and 58 for minimizing chafing due to engagement with the legs of the bracket 48 as well as to provide a cushion for absorbing the impact of such engagement. Such plastic tubing in the form of the length 74 may also be used on one of the legs of the bracket 48 as may be desired for the same reasons.

A tension spring 76 is connected between the end of arm 56 as shown and a respective one of the channels 12 and 14. By this means, the pivot frame 54 is yieldably urged clockwise about the pivot post 52 as viewed in both FIGS. 1 and 2. As shown more clearly in FIG. 2, an electrical switch 78 which is operable between "on" and "off" positions is positioned adjacent to one of the frames 54*a* to be engaged and operated thereby. Suitable electrical connections indicated by the numeral 80 lead from the switch 78 to the motor 36 for controlling the energization and deenergization of the latter.

In explaining the operation of the invention thus far described, it will be assumed that strand in the form of aluminum tubing is coiled on the reel 42. The strand is threaded from the reel 42 in the form of a circular coil around the outside of the cam rollers 66, i.e., along the side of the roller 66 radially distant from the reel 42. Being thus routed, the strand 44 forms a coil 44*a* substantially concentric with the post 16 which is substantially larger than the reel 42. The tension exerted by the springs 76 is sufficiently forceful under the circumstances to hold or form the coil 44*a* outward from the reel 42 without the respective pivot frames 54 being forced into engagement with the respective brackets 48. Thus, any change in tension on the strand 44 will result in the frames 54 being pivoted correspondingly with the springs 76 always urging the frames 54 outwardly to maintain the size and shape of the coil 44*a*.

Absent any tension on the strand 44, the springs 76 swing the respective pivot frames 54 clockwise to their maximum extent. With respect to the frame 54*a*, the switch 78 is thus activated to one state, this state, for example being closed. Engagement of the arm 56 of the frame 54*a* with the plunger on the switch 78 as shown serves in closing the switch 78. The circuitry 80 which includes suitable relays and power line connections serve in disconnecting the motor from and connecting the brake (of the combination 36) to the power line. Should tension be exerted on the strand 44 in the direction of the arrow "F", all of the frames 54, 54*a* will be pivoted to a limited degree counterclockwise moving the cam rollers 66 radially inwardly toward the reel 42. This happens before any rotation is imparted to the reel 42, since the tension exerted is cushioned by the pivot frames 54, 54*a* to prevent more than a corresponding tangential force from being applied to the reel 42, this being insufficient to rotate the reel or to cause the outermost coil of tubing 44 from embedding within or chafing against adjacent coils. However, by reason of the counterclockwise movement of the pivot frame 54*a*, the switch 78 is activated to an opposite state wherein the contacts thereof are opened. This results in the circuitry 80 causing energization of the motor and the deenergization of the brake in the combination 36 which now drives the reel 42 counterclockwise as viewed in FIG. 2. The strand 44 may now be pulled in a direction of the arrow "F" with a velocity corresponding to the driven speed of rotation of the reel 42. Should the pull or tension on the strand 44 be relaxed or stopped, the frames 54, 54*a* will as a consequence swing clockwise under the force of the respective springs 76 until the frame 54*a* engages and activates the switch 78 to its first state. This then results in deenergization of the motor and energization of brake 36 and the slowing and stopping of the reel 42. Thus, if the rotational speed of the reel 42 and consequent paying out of strand 44 exceeds that of the speed at which strand 44 is being consumed or pulled in the vicinity of the arrow "F", the tension on the coil 44*a* will relax permitting the pivot frames 54 to pivot clockwise. As the frame 54*a* engages the switch 78, the motor will be deenergized and the brake energized thereby removing the driving force from and the stopping of the reel 42. However, as the pull on the strand 44 in the direction of the arrow "F" continues, the frames 54, 54*a* will once again be pivoted counterclockwise causing opposite activation of the switch 78 and energization of the motor and deenergization of the brake in combination 36. This imparts rotation to the reel 42 which once again starts supplying strand or tubing 44 for withdrawal in the direction of the arrow "F".

The coil 44*a* serves two functional purposes. With respect to the starting of a strand-dispensing operation, the reel 42, of course, is initially stationary. When a pull in the direction of arrow "F" is exerted on the strand 44, the coil 44*a* reduces in size thereby causing energization of the motor and deenergization of brake 36. The coil thus serves as a cushion or slack which prevents excessive tension from being directly applied to the reel 42. Embedment of the strands within or chafing against other strands or coils on the reel are thus prevented. Furthermore, reduction in size of the coil 44*a* serves in sensing that pull has started or changed. This reduction in coil 44*a* size thus causes energization of the motor and deenergization of the brake 36. Conversely, enlargment of the coil 44*a* serves in deenergizing or stopping the motor and energization of the brake in combination 36.

The mechanism of this invention is, therefore, power driven in its dereeling or dispensing operation, this function being automatic.

While there have been described above the principles of this invention in connection with specific apparatus, it is to be clearly understood that this description is made only by way of example and not as a limitation to the scope of the invention.

What is claimed is:

1. Power driven dereeling apparatus comprising a rigid, stationary supporting frame, a reel of coiled strand, driven means on said frame for mounting and rotating said reel, driving means for imparting rotation to said driven means, a plurality of strand-engaging devices disposed radially outwardly beyond said reel, said devices being spaced circumferentially with respect to said reel to define a circular coil path of larger diameter than said reel;

each device including a pivot frame having two spaced parallel arms and a roller extending therebetween, a pivot shaft connected at its opposite end portions to said arms, respectively, said pivot shaft being parallel to said roller and spaced therefrom to define a captive strand-receiving opening, the axes of said shaft and roller being parallel to the axis of said reel, a bracket mounted on said stationary frame and pivotally supporting said shaft, said bracket being generally U-shaped with the open ends thereof secured to said supporting frame, said pivot shaft being mounted at one end on said supporting frame and at the other end on said bracket to dispose said pivot frame inside said bracket, anti-chafing material on one leg of said bracket and on said arms between the respective roller and pivot shaft for minimizing chafing of the strand, each pivot frame having a spring operatively connected thereto for urging said pivot frame in a direction to swing said roller away from said reel, said spring being tensioned between the other end of said arms and said supporting frame, an electrical switch operatively connected to one of said strand-engaging devices and being oppositely operated in response to pivotal movement of said pivot frame thereof between first and second positions, respectively; said driving means being an electric motor and brake operatively connected to said switch and controlled thereby, said motor being actuated and said brake deactuated when said switch is operated in one direction and said motor being deactuated and said brake actuated when said switch is operated oppositely.

2. The apparatus of claim 1 wherein said other end of said pivot shaft is connected to the cross bar of said bracket, said anti-chafing material being in the form of sections of plastic tubing on said leg of said bracket and said arms of said pivot frame.

3. The apparatus of claim 1 wherein there are five such strand-engaging device which are spaced to encircle substantially said reel.

4. The apparatus of claim 1 wherein said driven means includes a horizontal table rotatable about an upright axis, a sprocket concentrically secured to said table by means of a spacer, an upstanding stationary shaft secured at its lower end to said supporting frame and being received by clearance openings in said table, sprocket and spacer, bearings affixed to said table and sprocket and mounted for rotation on said stationary shaft, a series of rollers carried by said supporting frame, said sprocket resting on said rollers and thereby being rotatable about said shaft and said supporting frame, and a chain drive connecting said motor to said sprocket.

* * * * *